US006473910B2

(12) United States Patent
Creagan et al.

(10) Patent No.: US 6,473,910 B2
(45) Date of Patent: Nov. 5, 2002

(54) COOLING GARMENT

(75) Inventors: Christopher Cosgrove Creagan, Marietta; Charles Edward Bolian, II, Buford; Irwin Jerold Singer, Lawrenceville, all of GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 10/004,619

(22) Filed: Nov. 1, 2001

(65) Prior Publication Data

US 2002/0073481 A1 Jun. 20, 2002

Related U.S. Application Data

(60) Provisional application No. 60/257,245, filed on Dec. 20, 2000.

(51) Int. Cl.[7] ..... A62B 17/00; A62D 5/00

(52) U.S. Cl. ..... 2/458; 2/69; 2/81; 2/102

(58) Field of Search ..... 2/458, 69, 81, 2/102, 93, 97, 272, 275

(56) References Cited

U.S. PATENT DOCUMENTS 4,580,408 A * 4/1986 Stuebner ..... 2/2.5
5,538,583 A * 7/1996 Szczesuil et al. ..... 156/291
5,606,746 A * 3/1997 Shelton et al. ..... 2/102
5,885,912 A * 3/1999 Bumbarger ..... 442/238
5,901,373 A * 5/1999 Dicker ..... 2/243.1
6,018,819 A * 2/2000 King et al. ..... 2/69
6,286,145 B1 * 9/2001 Welchel et al. ..... 128/873
6,308,344 B1 * 10/2001 Spink ..... 2/100

* cited by examiner

*Primary Examiner*—John J. Calvert
*Assistant Examiner*—Robert H. Muromoto, Jr.
(74) *Attorney, Agent, or Firm*—Ralph H. Dean, Jr.

(57) ABSTRACT

A durable, single or multi-use cooling garment is provided having a multilayer structure. The cooling garment includes an inner layer of a thermoplastic polymer material that is liquid impermeable and vapor permeable, an outer liquid permeable reinforcing layer such as a web of thermoplastic polymer fibers, and a central absorbent layer that contains a stabilized matrix of about 55% to 95% cellulosic fibers and from about 5% to 45% thermoplastic polymer fibers. The layers are bonded together and the absorbent layer is bonded to at least one of the other layers by regionally applying sufficient energy to the layers wherein the thermoplastic polymers melt and resolidify to form inter-fiber bonds. The cooling garment can be saturated with water or other liquids and provide the wearer with relief from the heat such as may be achieved by evaporative cooling.

22 Claims, 1 Drawing Sheet

COOLING GARMENT

This application claims priority from provisional application Ser. No. 60/257245, filed Dec. 20, 2000.

BACKGROUND OF THE INVENTION

Vests and other apparel have previously been modified to include liquid or other materials to actively cool the wearer and/or protect the wearer from high heat. As an example, cooling garments and/or protective garments are described in U.S. Pat. No. 4,580,408, U.S. Pat. No. 5,606,746 and U.S. Pat. No. 5,885,912. Cooling is achieved by evaporation of water or other volatile liquid from the garment. Cooling garments are commonly worn while the wearer is active and including when the wearer is undertaking strenuous activity. In this regard, many absorbent layers can lose retained water during the activity as a result of the bending and creasing of the garment that occurs naturally through use. Further, compression of the absorbent layer while saturated can cause dislodging of the absorbent material and/or formation of clumps of the absorbent material. This can reduce absorbency of the materials, reduce the rate of evaporation and/or provide for uneven cooling across the garment. Thus, cooling garments having an absorbent layer that can better withstand the applied forces associated with the physical activity of the wearer are desired. In addition, often the conditions under which the cooling vests are worn expose the worker to unpleasant and/or unhealthy materials and in such instances it may be necessary and/or desirable to dispose of the garment after several or even a single use. Accordingly, cooling garments that can withstand the physical activity of the wearer and yet which can be provided economically so as to be capable of being a single-use or multi-use product are also highly desirable.

SUMMARY OF THE INVENTION

The aforesaid needs are fulfilled and the shortcomings of the prior art overcome by a cooling garment of the present invention which is a durable multilayer laminate adapted to be worn about the body and comprises (a) an inner barrier layer comprising a thermoplastic polymer material having a hydrohead of at least about 35 mbar and a water vapor transmission rate of at least about 800 g/m$^2$/24 hours; (b) an outer reinforcing layer comprising a web of thermoplastic polymer fibers and having a hydrohead less than about 25 mbar and a water vapor transmission rate of at least about 800 g/m$^2$/24 hours; (c) an absorbent layer, disposed between the barrier layer and the reinforcing layer, comprising a stabilized matrix of about 55% to 95% cellulosic fibers and from about 5% to 45% thermoplastic polymer fibers. The absorbent layer is desirably regionally bonded wherein the bond area comprises less than about 20% of the surface area of the laminate. Further, the absorbent layer may be bonded to at least one of the outer reinforcing layer or the inner barrier layer by regionally applying sufficient energy to the layers such that the thermoplastic polymer melts and resolidifies to form inter-fiber bonds. In one aspect, the bonded regions may comprise a series of continuous bonding lines or a series of staggered discontinuous line segments. Desirably, the bonding lines or segments extend substantially horizontally when the garment is worn. Still further, the edges of the cooling garment may be continuously bonded and form a substantially liquid impervious seal. The cooling garment can comprise one or more articles such as, for example, vests, shirts, pants, gowns, jump-suits, caps, and so forth.

DEFINITIONS

As used herein and in the claims, the term "comprising" is inclusive or open-ended and does not exclude additional unrecited elements, compositional components, or method steps. Accordingly, the term "comprising" encompasses the more restrictive terms "consisting essentially of" and "consisting of."

As used herein, all percentages, ratios and proportions are by weight unless otherwise specified.

As used herein the term "nonwoven" fabric or web means a web having a structure of individual fibers or threads which are interlaid, but not in an identifiable manner as in a knitted or woven fabric. Nonwoven fabrics or webs have been formed by many processes such as, for example, meltblowing processes, spunbonding processes, conforming, hydroentangling, air-laid and bonded carded web processes.

As used herein, the term "spunbonded fibers" refers to fibers which are formed by extruding molten thermoplastic material as filaments from a plurality of fine, usually circular capillaries of a spinneret with the diameter of the extruded filaments then being rapidly reduced as by, for example, U.S. Pat. No. 4,340,563 to Appel et al., and U.S. Pat. No. 3,692,618 to Dorschner et al., U.S. Pat. No. 3,802,817 to Matsuki et al., U.S. Pat. Nos. 3,338,992 and 3,341,394 to Kinney, U.S. Pat. No. 3,502,763 to Hartman; U.S. Pat. No. 3,542,615 to Dobo et al.; and U.S. Pat. No. 5,382,400 to Pike et al.; the entire content of each is incorporated herein by reference. Spunbond fibers are generally not tacky when they are deposited onto a collecting surface. Spunbond fibers are generally continuous and have average diameters (from a sample of at least 10) larger than 7 microns to about 50 or 60 microns, often, between about 15 and 25 microns.

As used herein, the term "meltblown fibers" means fibers formed by extruding a molten thermoplastic material through a plurality of fine, usually circular, die capillaries as molten threads or filaments into converging high velocity, usually hot, gas (e.g. air) streams which attenuate the filaments of molten thermoplastic material to reduce their diameter, which may be to microfiber diameter. Thereafter, the meltblown fibers are carried by the high velocity gas stream and are deposited on a collecting surface to form a web of randomly dispersed meltblown fibers. Such a process is disclosed, for example, in U.S. Pat. No. 3,849,241. Meltblown fibers are microfibers, which may be continuous or discontinuous, and are generally smaller than 10 microns in average diameter, and are generally tacky when deposited onto a collecting surface.

As used herein, the term "polymer" generally includes, but is not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configurations of the molecule. These configurations include, but are not limited to isotactic, syndiotactic and random symmetries.

As used herein a "superabsorbent" or "superabsorbent material" refers to a water-swellable, water-soluble organic or inorganic material capable, under favorable conditions, of absorbing at least about 10 times its weight and, more desirably, at least about 20 times its weight in water. Organic materials suitable for use as a superabsorbent material in conjunction with the present invention include, but are not limited to, natural materials such as guar gum, agar, pectin and the like; as well as synthetic materials, such as synthetic hydrogel polymers. Such hydrogel polymers include, for example, alkali metal salts of polyacrylic acids, polyacrylamides, polyvinyl alcohol, ethylene, maleic anhydride copolymers, polyvinyl ethers, methyl cellulose, carboxymethyl cellulose, hydroxypropylcellulose, polyvinylmorpholinone, and polymers and copolymers of vinyl sulfonic acid, polyacrylates, polyacrylamides, polyvinylpyrridine, and the like. Other suitable polymers include hydrolyzed acrylonitrile grafted starch, acrylic acid grafted starch, and isobutylene maleic anhydride polymers and mixtures thereof. The hydrogel polymers are preferably lightly crosslinked to render the materials substantially water insoluble. Crosslinking may, for example, be accomplished by irradiation or by covalent, ionic, van der Waals, or hydrogen bonding. The superabsorbent materials may be in any form suitable for use in absorbent composites including particles, fibers, flakes, spheres and so forth. Superabsorbents are generally available in particle sizes ranging from about 20 to about 1000 microns.

As used herein, the term "conform material" means composite materials comprising a mixture or stabilized matrix of thermoplastic fibers and a second non-thermoplastic material. As an example, conform materials may be made by a process in which at least one meltblown die head is arranged near a chute through which the non-thermoplastic material are added to the web while it is forming. The second non-thermoplastic material may be, for example, pulp, superabsorbent particles, cellulose fibers, staple fibers and other particles. In the present invention, the non-thermoplastic material is the combination of the absorbent material and the odor controlling material. Exemplary conform materials are disclosed in commonly assigned U.S. Pat. No. 5,284,703 to Everhart et al.; U.S. Pat. No. 5,350,624 to Georger et al.; and U.S. Pat. No. 4,100,324 to Anderson et al.; the entire content of each is incorporated herein by reference.

As used herein, the term "porous" refers to a substrate or material that has interstitial spaces or openings located therein such that there exist pathways that extend through the entire thickness of the material, individual interstitial spaces need not extend through the entire thickness of the material and can collectively form pathways through the material via adjacent, inter-connecting spaces.

The term "denier" is defined as grams per 9000 meters of a fiber. For a fiber having circular cross-section, denier may be calculated as fiber diameter in microns squared, multiplied by the density in grams/cc, multiplied by 0.00707. A lower denier indicates a finer fiber and a higher denier indicates a thicker or heavier fiber. Outside the United States the unit of measurement is more commonly the "tex," which is defined as the grams per kilometer of fiber. Tex may be calculated as denier/9. The "mean fiber denier" is the sum of the deniers for each fiber, divided by the number of fibers.

As used herein, the term "machine-direction" or MD means the direction of a fabric corresponding to the direction in which it was produced. The term "cross-direction" or CD means the direction of a fabric generally perpendicular to the MD.

As used herein, the term "body-side" or "inner" refers to the side of a material that will face the wearer of the article and the term "outer" refers to the opposing side that faces away from the body, i.e. distal to the body when the article incorporating the material is worn.

DESCRIPTION OF THE INVENTION

Figure 1:
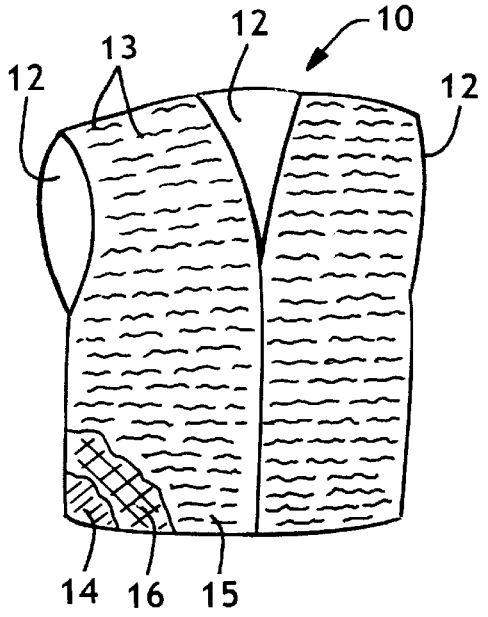
FIG. 1 depicts a cooling garment of the present invention having a partially broken-away view of the composite material forming the same.
Figure 2:
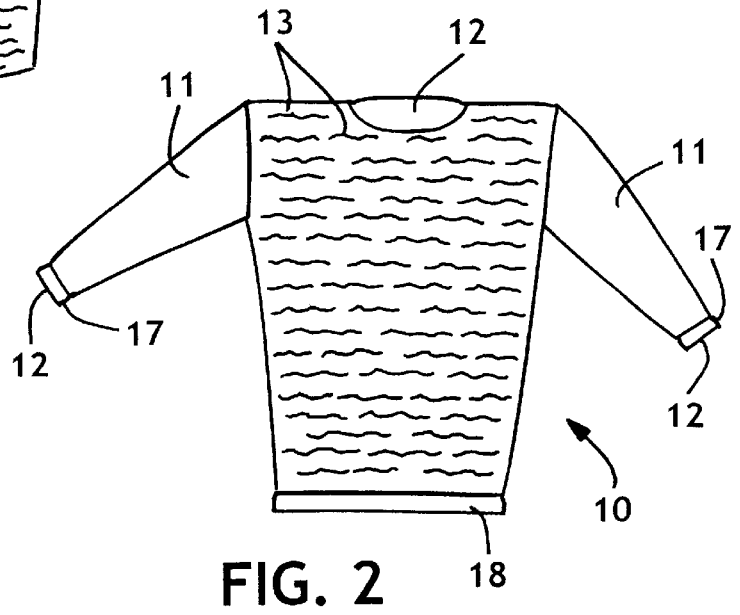
FIG. 2 depicts another cooling garment of the present invention.

In reference to FIG. 1, the cooling garment 10 can comprise an article adapted to be worn about the body such as, for example, having one or more openings 12 through which the head and limbs can protrude. Similarly, in reference to FIG. 2, the cooling garment 10 can comprise an article adapted to be worn about the body by having one or more extensions or sleeves 11 and corresponding openings 12 through which the hands and arms can protrude. The cooling garment 10 can comprise a composite structure having an inner barrier layer 14, an outer reinforcing layer 15 and an absorbent layer 16 disposed therebetween.

With respect to FIG. 1, the garment may, in one aspect, comprise a vest having closing means to secure the vest to the wearer. Suitable closure means include, but are not limited to, zippers, buttons, ties, snaps, belts, hook and loop attachments (e.g. VELCRO® fasteners), and so forth. In a further aspect and in reference to FIG. 2, the garment can comprise a pullover or other item designed to securely fit a wearer without the need for closure devices. Optionally, to improve the fit, the pullover may contain elastic cuffs 17 and/or elastic waistbands 18. The size as well as the specific design or configuration of the garment can vary and in this regard it is noted that a wide variety of garment designs, both functional and/or aesthetic, can be used in conjunction with the present invention. In addition, while not described herein, numerous other attributes commonly found in garments can be incorporated into the garments of the present invention including, but not limited to, hoods, collars, elastic bands, draw strings, pockets and so forth. In addition, while the garments depicted herein are to be worn about the upper body or torso, it will be readily appreciated that the garment could likewise be adapted in a similar fashion for use as trunks, pants and/or a full-body suit. Still further, while the garments depicted herein are with respect to human use, the garments can be readily adapted to be worn about animals as well as inanimate articles that need to be cooled.

The inner barrier layer comprises a thermoplastic polymer material that is substantially impervious to the transmission of liquids. The barrier layer desirably has a hydrohead value of at least about 35 mbar or more and, even more desirably, has a hydrohead value in excess of about 50 mbar. In addition, it is also desirable that the barrier layer comprises a material that is "breathable" in the sense that, while impermeable to the transmission of liquids, air and/or water vapor can pass therethrough. Desirably, the barrier layer has a water vapor transmission rate (WVTR) of at least 800 $g/m^2/24$ hours and still more desirably has a WVTR in excess of about 1200 $g/m^2/24$ hours. In one embodiment, the barrier layer may itself comprise a film, a nonwoven fabric or a multilayer nonwoven laminate. As used herein "multilayer nonwoven laminate" means a laminate comprising a plurality of layers wherein at least one of the layers is a nonwoven fabric. As examples, suitable laminates include those wherein some of the layers are spunbond and some meltblown such as a spunbond/meltblown/spunbond (SMS) laminate as well as those disclosed in U.S. Pat. No. 4,041, 203 to Brock et al., U.S. Pat. No. 5,169,706 to Collier et al., U.S. Pat. No. 5,178,931 to Perkins et al., and U.S. Pat. No. 5,188,885 to Timmons et al.; the entire contents of each of the aforesaid references are incorporated herein by reference. Such a laminate may be made by sequentially depositing onto a moving forming belt first a spunbond fabric layer, then a meltblown fabric layer and last another spunbond layer and then bonding the layers together thereby forming a laminate. Alternatively, the fabric layers may be made individually, collected in rolls, and combined in a separate bonding step. Multilayer laminates may also have various numbers of meltblown layers or multiple spunbond layers in many different configurations and may include other materials such as films (F), e.g. SMMS, SM, SF, SFS, etc.

An exemplary barrier layer can comprise a first layer having a basis weight of at least about 12 g/m$^2$ and comprising thermoplastic polymer microfibers having an average fiber denier below about 0.25 and wherein the first layer is positioned between opposed second and third layers having a basis weight of at least about 12 g/m$^2$ each and comprising substantially oriented fibers having an average fiber denier of about 2 or more. As a particular example, the inner barrier layer can comprise an SMS fabric having opposed spunbond layers with a basis weight between about 14 g/m$^2$ and 34 g/m$^2$ and an intermediate meltblown fiber layer having a basis weight between about 12 g/m$^2$ and about 34 g/m$^2$. In an alternate embodiment, the barrier layer may comprise a microporous film and/or a film/nonwoven laminate. One particularly useful barrier material comprises a breathable stretched filled microporous film. Such films are typically filled with particles and then crushed and/or stretched to form a fine pore network throughout the film. The film-pore network allows gas and water vapor to pass through the film while acting as a barrier to liquids and particulate matter. The amount of filler within the film and the degree of stretching are controlled so as to create a network of micro-pores of a size and/or frequency to impart the desired level of breathability to the fabric. Suitable microporous film and film laminates are disclosed in U.S. Pat. No. 4,777,073 to Sheth, U.S. Pat. No. 5,695,868 to McCormack, U.S. Pat. No. 6,075,179 to McCormack et al., and U.S. Pat. No. 6,037,281 to Mathis et al.; the entire content of each of the aforesaid references are incorporated herein by reference. The films desirably include one or more tackifiers and/or thin bonding layers in order to allow and/or improve thermal bonding of the laminate to the absorbent core or other intermediate layers.

The outer reinforcing layer desirably comprises a polymeric fabric that is sufficiently porous so as to allow the transfer of liquids there through and into the absorbent layer. Additionally, the outer layer also needs to be sufficiently durable and strong to withstand the rigors associated with wear and use of the garment. In this regard, desirably the outer layer has a Grab Tensile of at least about 2 kg and still more desirably has a Grab Tensile of at least about 5 kg. The outer reinforcing layer desirably comprises a material having a basis weight between about 12 g/m$^2$ and 50 g/m$^2$ and still more desirably a material having a basis weight between about 17 g/m$^2$ and about 34 g/m$^2$. In addition, the outer reinforcing fabric desirably has a hydrohead value of less than about 25 mbar and still more desirably a hydrohead value of between 0 and about 15 mbar. Desirably, the outer reinforcing layer comprises a bonded web of thermoplastic polymer fibers. An exemplary material comprises spunbond fiber webs such as, for example, those described in U.S. Pat. No. 3,802,817 to Matsuki et al., U.S. Pat. No. 5,382,400 to Pike et al., U.S. Pat. No. 5,874,460 to Keck, U.S. Pat. No. 5,460,884 to Kobylivker et al., U.S. Pat. No. 5,336,552 to Strack et al. and U.S. Pat. No. 5,858,515 to Stokes et al., the entire contents of each of the aforesaid references are incorporated herein by reference. In a further aspect, in order to provide improved coverage or opacity to the outer reinforcing layer, the outer reinforcing layer can itself comprise a laminate material such as for example a low basis weight spunbond/meltblown (SM) or spunbond/meltblown/spunbond (SMS) laminate. Exemplary SM and SMS laminates are described in U.S. Pat. No. 4,041,203 to Brock et al. and U.S. Pat. No. 5,607,798 to Kobylivker et al. In addition the outer reinforcing layer may be a nonwoven web laminate of thermoplastic polymer fibers having a denier below 0.5 and a nonwoven web of thermoplastic polymer fibers having a denier greater than 0.5. However, due to the need to have adequate liquid penetration the reinforcing layer can optionally be made hydrophilic such as by treatment with internal or topical wetting agents, use of hydrophilic polymers and so forth.

Positioned between the reinforcing layer and inner barrier layer is an absorbent layer or core that comprises one or more layers capable of absorbing liquids such as, for example, water. The absorbent core desirably comprises a combination or mixture of thermoplastic fibers and an absorbent material structured such that the absorbent material is substantially held in place. The absorbent core can comprise coform materials although other suitable absorbent fabrics comprising a combination of thermoplastic fibers and absorbent material may likewise be used in accord with the present invention. Exemplary coform materials are disclosed in commonly assigned U.S. Pat. No. 5,284,703 to Everhart et al. U.S. Pat. No. 5,350,624 to Georger et al. and U.S. Pat. No. 4,100,324 to Anderson et al.; the entire contents of which are incorporated herein by reference. The term "coform material" generally refers to composite materials comprising a mixture or stabilized matrix of thermoplastic fibers and a second non-thermoplastic material. As an example, coform materials may be made by a process in which at least one meltblown die head is arranged near a chute through which other materials are added to the web while it is forming. Such other materials may include, but are not limited to, fibrous organic materials such as woody or non-woody pulp such as cotton, rayon, recycled paper, pulp fluff and also superabsorbent particles, inorganic absorbent materials, treated polymeric staple fibers and so forth. The absorbent core desirably has a specific capacity of at least about 5 g/g and still more desirably a specific absorbent capacity of at least about 8 g/g. In an exemplary embodiment the absorbent core comprises at least about 100 g/m$^2$ coform material, and even more desirably comprises from about 200 g/m$^2$ to about 500 g/m$^2$ coform material. Further, the coform material preferably comprises from about 5% to about 45% thermoplastic polymer fibers and still more desirably comprises from about 10% to about 35% by weight thermoplastic polymer fibers. As one example, the coform material can comprise polypropylene meltblown fibers and wood pulp fibers. As a further example, the absorbent material may be held in a web of thermoplastic staple fibers such as, for example, air-laid or bonded-carded webs. The absorbent core may comprise one or more layers and additional materials, e.g. absorbent materials or particles, may be dispersed within or between the one or more layers to increase the absorbency as desired. As an example U.S. Pat. No. 4,784,892 to Storey et al. teaches an absorbent material of meltblown fibers with an absorbent fibrous material (e.g. wood pulp) as well as superabsorbent dispersed therein; the entire contents of the aforesaid application is incorporated herein by reference. When the superabsorbent is present in the absorption layer, it is generally present in an amount between about 0.5 to about 40% by weight, more generally in and amount about 1% to about 20% by weight of the absorbent layer.

In addition, the absorbent layer may be patterned bonded forming a series of bond segments and wherein the bond segments comprise less than about 20% of the surface area of the absorbent layer.

The multiple layers can be attached to one another by one or more methods known in the art. Desirably, the layers are bonded in a manner so as to hold the absorbent layer in a substantially fixed position between the inner barrier layer and outer reinforcing layer. As an example, each of the respective layers can be bonded together to form an integrated laminate through the use of adhesives. Adhesives, such as latexes or hot melts, can be applied to the sheets by gravure rolls, spray equipment and so forth. Still further, the multiple layers can be thermally and/or ultrasonically laminated together to form an integrated laminate. In reference to FIG. 1, the multiple layers can be bonded together at a plurality of bond regions 13 using sufficient energy to melt the polymeric portions of the respective layers such that, upon resolidification, a cohesive bond is formed between adjacent layers. This form of bonding can be accomplished by thermal, ultrasonic or other comparable bonding methods. Exemplary ultrasonic bonding processes are described in U.S. Pat. Nos. 4,100,324 and 4,605,454. Generally, ultrasonic bonding involves passing the fabric to be bonded between an anvil and a sonic horn. The layers to be bonded are passed through an ultrasonic embossing station which, in one aspect, can comprise an ultrasonic calendering head vibrating against a patterned anvil roll. The embossing conditions (e.g., pressure, speed, power input) as well as the embossing pattern may be appropriately selected to provide the desired characteristics in the final-product. In a further aspect, one or more webs may be thermally pattern-bonded and which typically involves passing the web or webs to be bonded between a pair of heated bonding rolls. One of the bonding rolls is often patterned in some way so that the fabric is not bonded across its entire surface and the second or anvil roll is either a patterned or smooth roll.

Figure 3:
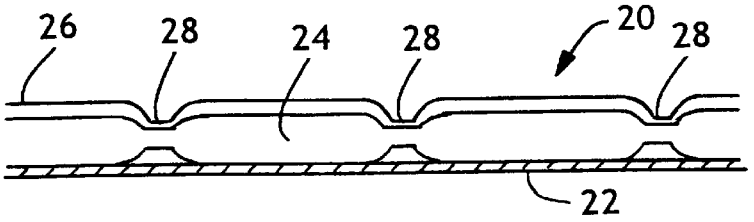
FIG. 3 is a cross-sectional view of a composite material suitable for forming a cooling garment of the present invention.
Figure 4:
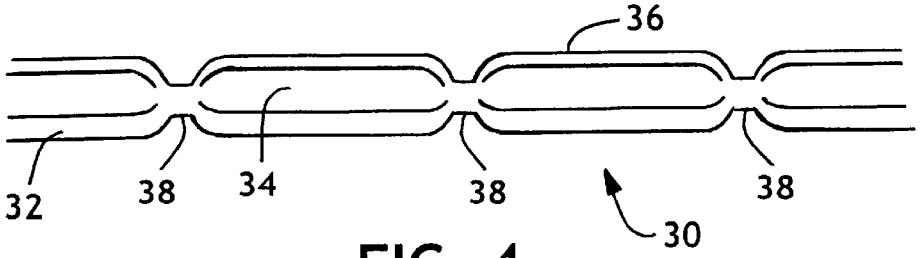
FIG. 4 is a cross-sectional view of a composite material suitable for forming a cooling garment of the present invention.

As previously indicated, the layers can be bonded together to form a durable laminate by one or more methods including, for example, thermal, adhesive and/or ultrasonic bonding. Desirably, the layers are thermally or ultrasonically bonded together using patterned bonding. Various bond patterns have been developed for functional as well as aesthetic reasons. In this regard, the layers are desirably bonded over less than the entire surface area of the fabric using an intermittent or spaced pattern of band areas. Desirably, the bond area is between about 2% and about 20% of the surface area of the fabric and still more desirably between about 4% and about 10% of the fabric. Still further, the bonding pattern desirably employs a pattern comprising a plurality of spaced, repeating bond segments. In reference to FIG. 3, composite material 20 comprises an inner barrier layer 22, a medial absorbent layer 24 and an outer reinforcing layer 26. Absorbent layer 24 and reinforcing layer 26 are pattern bonded at bond segments 28 thereby forming a cohesive laminate. Inner barrier layer 22 is adhesively bonded to the absorbent layer 24 and thus the inner barrier layer 22, medial absorbent layer 24 and outer reinforcing layer 26 form a unitary, cohesive composite material 20. Alternatively, both the inner barrier layer and outer reinforcing layer can be attached to the absorbent layer by adhesives. In another embodiment, and in reference to FIG. 4, inner barrier layer 32, medial absorbent layer 34 and outer reinforcing layer 36 can all be pattern bonded at bond segments 38 so as to form a unitary, cohesive composite material 30. While various bond patterns can be used, desirably a bond pattern is employed comprising a series of elongated bond segments and even more desirably comprise substantially continuous bonding line segments or continuous boding lines. Sinusoidal bonding patterns are believed particularly well suited for use in forming cooling garments of the present invention. Still further, and in reference to FIGS. 1 and 2, desirably the bond lines or segments extend substantially in the horizontal direction. Further, the bonding lines desirably extend around the entire product or across major sections of the garment in the horizontal direction. In addition, when using a series of discontinuous and/or discrete bond segments it is further desirable that the patterns have a series of staggered and/or offset bond segments such that the unbonded areas are not vertically aligned. By providing bond segments such as described above it is believed that uniform liquid retention throughout the garment is obtained since the compressed bonded areas will substantially limit downward flow of liquid within the absorbent. As specific examples, continuous sinusoidal bonding patterns and/or staggered discontinuous sinusoidal line segments are disclosed in U.S. Design Pat. Nos. 247,370; 247,371; 433,131 and 433,132; the entire contents of each of the aforesaid references are incorporated herein by reference.

In a further aspect, the edges or periphery of the garment may be sealed to prevent any loss of liquid therethrough. Desirably, the edges or periphery of the garment are sealed via thermal or ultrasonic bonding wherein the polymeric portions of the respective layers are subjected to sufficient energy and pressure such that the polymer melts and resolidifies. The bonding compresses the material greatly reducing the open areas and spaces therein. In addition, resolidification of the polymer maintains the composite in the compressed state. As indicated above, the bonding and resolidification of the polymer creates a region that is less capable of absorbing and/or transferring liquid. Alternatively, the edges may be sealed through the use of adhesives, waxes and so forth.

The composite laminate can be used to form a garment by itself or together with additional materials and/or fabrics. For example, as depicted in FIG. 1, the composite laminate can itself form the cooling vest. In an alternate embodiment, and in reference to FIG. 2, the composite laminate can form a portion of the garment wherein the absorbent laminate extends over the torso and another material, e.g. a nonwoven fabric or film/nonwoven laminate, forms the sleeves of the garment. It will be appreciated that numerous other garment configurations containing sections of the composite material are also possible.

TESTS

Hydrohead Values: Hydrohead as used herein refers to a measure of the liquid barrier properties of a fabric. The hydrohead test determines the height of water (in millibars or centimeters) which the fabric will support before a predetermined amount of liquid passes through. A fabric with a higher hydrohead reading indicates it is a greater barrier to liquid penetration than a fabric with a lower hydrohead. The hydrohead test can be performed according to Federal Test Method Standard 191A, Method 5514 or using a hydrostatic head tester available from Marlo Enterprises, Inc. of Concord, N.C. Unlike Method 5514, when using a hydrohead test the specimen is subjected to a standardized water pressure, increased at a constant rate until the first sign of leakage appears on the surface of the fabric in three separate areas. (Leakage at the edge, adjacent clamps is ignored.) Unsupported fabrics, such as a thin film, can be supported to prevent premature rupture of the specimen.

Absorbency: a 4 inch (102 mm) by 4 inch (102 mm) specimen is initially weighed. The weighed specimen is then soaked in a pan of test fluid (e.g. water) for ten minutes. The test fluid should be at least three centimeters deep in the pan. The specimen is removed from the test fluid and allowed to drain while resting horizontal upon a mesh support screen. The specimen is allowed to drain for one minute. After the allotted drain time the specimen is placed in a weighing dish and then weighed. Absorption Capacity (g)=wet weight (g)−dry weight (g); and Specific Capacity (g/g)=Absorption Capacity (g)/dry weight (g).

WVTR can be measured in accordance with the procedure known in the art, INDA (Association of Nonwoven Fabrics Industry) number IST-70.4-99 entitled "Standard Test Method For Water Vapor Transmission Rate Through Nonwoven And Plastic Film Using a Guard Film And Vapor Pressure Sensor", the entire contents of this test is incorporated herein by reference. Equipment suitable for determining WVTR is the Permatran-W Model 100K available from Mocon/Modern Controls, Inc., Minneapolis, Minn.

Grab Tensile: The grab tensile test is a measure of breaking strength and/or strain of a fabric when subjected to unidirectional stress. This test is known in the art and is described in Method 5100 of the Federal Test Methods Standard 191A. The results are expressed in pounds or grams to break and higher numbers indicate a stronger fabric. The term "load" means the maximum load or force, expressed in units of weight, required to break or rupture the specimen in a tensile test. The grab tensile test uses two clamps, each having two jaws with each jaw having a facing in contact with the sample. The clamps hold the material in the same plane, usually vertically, separated by 3 inches (76 mm) and move apart at a specified rate of extension. Values for grab tensile strength and grab elongation are obtained using a sample size of 4 inches (102 mm) by 6 inches (152 mm), with a jaw facing size of 1 inch (25 mm) by 1 inch, and a constant rate of extension of 300 mm/min. The sample is wider than the clamp jaws to give results representative of effective strength of fibers in the clamped width combined with additional strength contributed by adjacent fibers in the fabric. The specimen is clamped in, for example, a Sintech 2 Tester, available from the Sintech Corporation, 1001 Sheldon Dr., Cary, N.C. 27513, an Instron Model TM, available from the Instron Corporation, 2500 Washington St., Canton, Mass. 02021, or a Thwing-Albert Model INTELLECT II available from the Thwing-Albert Instrument Co., 10960 Dutton Rd., Philadelphia, Pa. 19154.

EXAMPLE 1

An outer reinforcing layer of SMS was formed from two 8.5 g/m$^2$ layers of polypropylene spunbond fibers and a medial 3 g/m$^2$ layer of polypropylene meltblown fibers. The layers were sequentially deposited over one another and then thermally point bonded using a bond pattern having a bonding area of approximately 15%. The inner barrier layer likewise comprised an SMS material. However, the inner barrier layer was formed from two 13.5 g/m$^2$ layers of polypropylene spunbond fibers and a medial 13.5 g/m$^2$ layer of polypropylene meltblown fibers. The layers were sequentially deposited over one another and then thermally point bonded using a bond pattern having a bonding area of approximately 15%. The absorbent core was made in accord with U.S. Pat. No. 4,100,324 to Anderson et al. and comprised a stabilized matrix of pulp fibers dispersed within a matrix of polypropylene meltblown fibers. The coform material comprised 30% by weight polypropylene fibers and 70% pulp and had a basis weight of 325 g/m$^2$. The absorbent core was sprayed with a surfactant, AHCOVEL (purchased from Hodgson Textile Chemicals Inc., a business having offices in Mount Holly, N.C., and includes a blend of hydrogenated ethoxylated castor oil and sorbitan monooleate). The absorbent core had an absorbent capacity of 21 g/g. The absorbent core was formed upon the outer reinforcing layer thereby forming a cohesive material. The inner barrier layer was sprayed with a hot melt adhesive and then juxtaposed with and place upon the exposed portion of the absorbent core thereby forming a cohesive multilayer laminate.

EXAMPLE 2

An outer reinforcing layer of SMS was formed from two 8.5 g/m$^2$ layers of polypropylene spunbond fibers and a medial 3 g/m$^2$ layer of polypropylene meltblown fibers. The layers were sequentially deposited over one another and then thermally point bonded using a bond pattern having a bonding area of approximately 15%. The inner barrier layer likewise comprised an SMS material. However, the inner barrier layer was formed from two 13.5 g/m$^2$ layers of polypropylene spunbond fibers and a medial 13.5 g/m$^2$ layer of polypropylene meltblown fibers. The layers were sequentially deposited over one another and then thermally point bonded using a bond pattern having a bonding area of approximately 15%. The absorbent core was made in accord with U.S. Pat. No. 4,100,324 to Anderson et al. and comprised a stabilized matrix of pulp fibers dispersed within a matrix of polypropylene meltblown fibers. The coform material comprised 30% by weight polypropylene fibers and 70% pulp and had a basis weight of 325 g/m$^2$. The absorbent core was sprayed with a surfactant, AHCOVEL (purchased from Hodgson Textile Chemicals Inc., a business having offices in Mount Holly, N.C., and includes a blend of hydrogenated ethoxylated castor oil and sorbitan monooleate). The absorbent core was formed upon the outer reinforcing layer thereby forming a cohesive material. The outer reinforcing layer, absorbent core and barrier layer were then thermally bonded with a pattern, similar to that depicted in U.S. Design Pat. No. 433,131, having a bond area of 12%.

While the invention has been described in detail with respect to specific embodiments thereof, and particularly by the examples described herein above, it will be apparent to those skilled in the art that various alterations, modifications and other changes may be made without departing from the spirit and scope of the present invention. It is therefore intended that all such modifications, alterations and other changes be encompassed by the claims.

We claim:

1. A cooling garment comprising:

an inner barrier layer comprising a thermoplastic polymer material having a hydrohead of at least about 35 mbar and a water vapor transmission rate of at least about 800 g/m$^2$/24 hours;

an outer reinforcing layer comprising a web of thermoplastic polymer fibers and having a hydrohead less than about 25 mbar and a water vapor transmission rate of at least about 800 g/m$^2$/24 hours;

an absorbent layer disposed between said barrier layer and said reinforcing layer, said absorbent layer comprising a stabilized matrix of about 55% to 95% cellulosic fibers and from about 5% to 45% thermoplastic polymer fibers;

said barrier layer, said reinforcing layer and said absorbent layer being bonded together to form a cohesive laminate;

said laminate comprising at least a portion of a garment adapted to be worn about the body.

2. The cooling garment of claim 1 wherein absorbent layer is patterned bonded forming a series of bond segments and wherein the bond segments comprise less than about 20% of the surface area of the absorbent layer.

3. The cooling garment of claim 2 wherein said absorbent layer is bonded to at least one of the outer reinforcing layer and the inner barrier layer by regionally applying sufficient energy to the layers wherein the thermoplastic polymers melt and resolidify to form cohesive bonds.

4. The cooling garment of claim 3 wherein said bond segments comprise a series of staggered, offset discontinuous bonding segments that extend substantially horizontally.

5. The cooling garment of claim 3 wherein said bond segments comprise a series of continuous bonding lines that extend substantially horizontally.

6. The cooling garment of claim 5 wherein said bonding lines have a sinusoidal pattern.

7. The cooling garment of claim 3 wherein said absorbent layer is bonded to both the barrier layer and reinforcing layer by the method selected from the group consisting of thermal bonding and ultrasonic bonding.

8. The cooling garment of claim 1 further comprising edges wherein the edges of said garment are continuously bonded and form a substantially liquid impervious seal.

9. The cooling garment of claim 1 wherein said cellulosic fibers of said absorbent layer comprise pulp and wherein said thermoplastic polymer fibers of said absorbent layer comprise meltblown fibers.

10. The cooling laminate of claim 1 wherein said reinforcing layer comprises a nonwoven web of thermoplastic polymer fibers having a denier below 0.5 and a nonwoven web of thermoplastic polymer fibers having a denier greater than 0.5.

11. The cooling garment of claim 1 wherein said barrier layer comprises an inner layer nonwoven web of spunbond fibers and outer layer nonwoven web of meltblown fibers.

12. The cooling garment of claim 1 wherein said barrier layer comprises a nonwoven web and a microporous thermoplastic polymer film.

13. The cooling garment of claim 11 wherein said thermoplastic polymer fibers in each of said layers comprises a propylene polymer.

14. The cooling garment of claim 1 wherein said garment comprises a vest.

15. The cooling garment of claim 14 wherein said garment has openings positioned to allow protrusion of a head and limbs of an user.

16. The cooling garment of claim 1 wherein said laminate extends over the entirety of said garment.

17. The cooling garment of claim 1 wherein said laminate extends over only a portion of said garment.

18. The cooling garment of claim 1 wherein said absorbent layer is saturated with a liquid.

19. The cooling garment of claim 18 wherein said liquid is water.

20. The cooling garment of claim 1 wherein said absorbent layer further comprises superabsorbent particles.

21. The cooling garment of claim 20 wherein the superabsorbent comprises about 0.5% to about 40% by weight of the absorbent layer.

22. The cooling garment of claim 21 wherein the superabsorbent comprise about 1% to about 20% by weight of the absorbent layer.

* * * * *